United States Patent [19]

VanDerZyl et al.

[11] 3,987,914

[45] Oct. 26, 1976

[54] TWO-PIECE BACKHOE BOOM

[75] Inventors: Roger Dale VanDerZyl, East Dubuque, Ill.; Larry Gene McMullen; Leroy Ernest Kraske, both of Dubuque, Iowa

[73] Assignee: Deere & Company, Moline, Ill.

[22] Filed: Nov. 4, 1975

[21] Appl. No.: 628,794

[52] U.S. Cl. ..... 214/138 R; 212/46 R

[51] Int. Cl.[2] ..... E02F 3/80

[58] Field of Search ..... 214/132, 131 R, 138 R, 214/138 C; 212/46 R, 46 A, 46 B

[56] References Cited

UNITED STATES PATENTS

| | | | |
|---|---|---|---|
| 2,433,368 | 3/1969 | Durand | 212/46 R |
| 3,376,984 | 4/1968 | Long et al. | 214/138 R |
| 3,712,490 | 1/1973 | Schaeff | 214/138 C |
| 3,734,320 | 5/1973 | Redenbarger | 214/138 R |
| 3,811,582 | 5/1974 | Shumaker et al. | 214/138 R |
| 3,848,756 | 11/1974 | Schaeff | 214/138 C |

FOREIGN PATENTS OR APPLICATIONS

| | | | |
|---|---|---|---|
| 1,325,817 | 3/1963 | France | 212/46 A |

*Primary Examiner*—L. J. Paperner

[57] ABSTRACT

A backhoe is mounted on the rear end of a tractor and includes a boom constructed of first and second separate sections which are interconnected by means that are selectively alterable to establish first and second conditions respectively wherein the first and second separate sections are fixed relative to each other to thereby establish a rigid boom for normal backhoe operation and wherein the first and second sections are pivotable relative to each other to thereby establish a foldable boom to permit the latter to be moved toward the tractor to a folded transport position.

8 Claims, 1 Drawing Figure

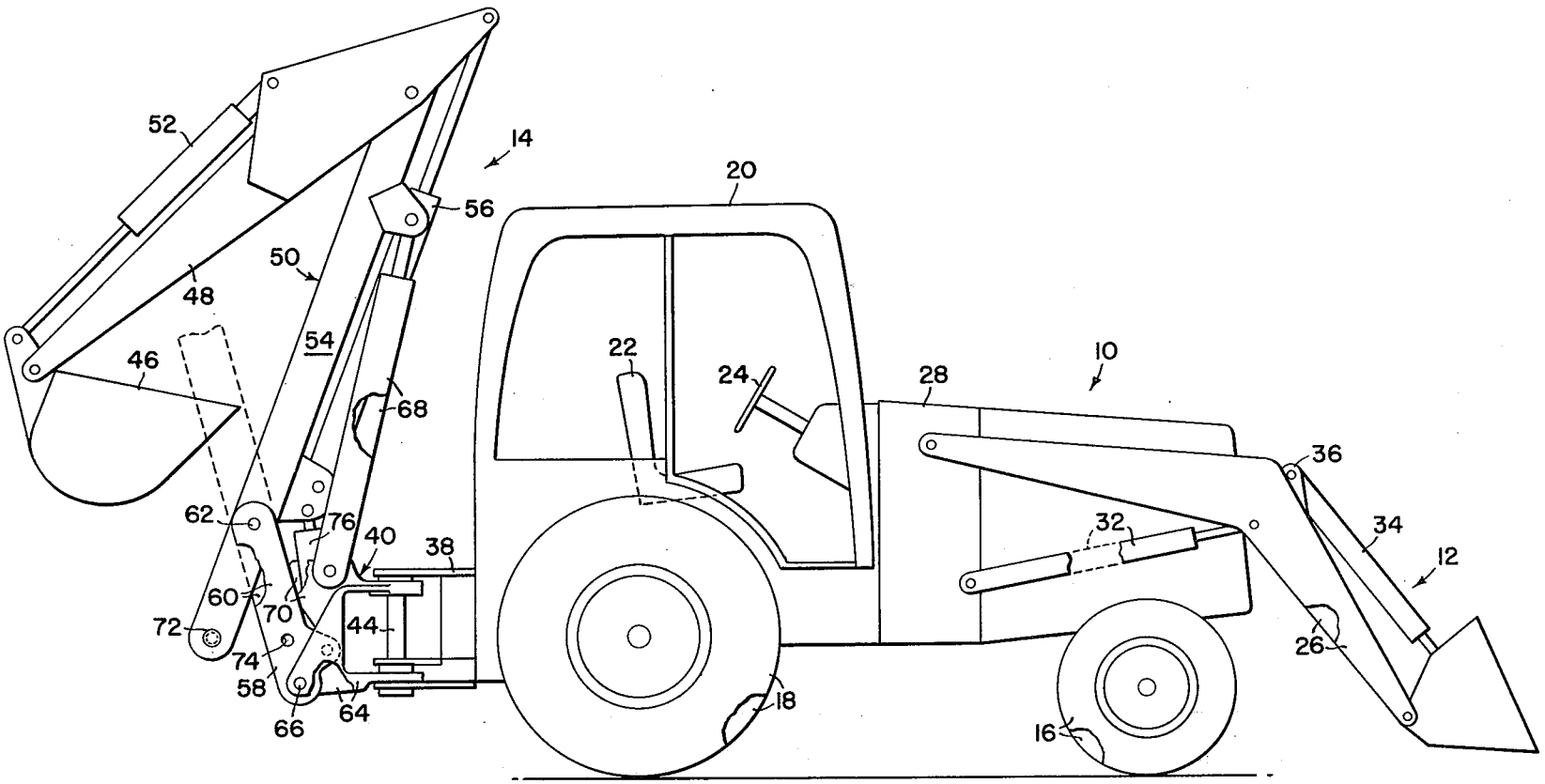
10
12
14
16
18
20
22
24
26
28
32
34
36
38
40
44
46
48
50
52
54
56
58
60
62
64
66
68
70
72
74
76

TWO-PIECE BACKHOE BOOM

BACKGROUND OF THE INVENTION

The present invention relates to a backhoe and more particularly relates to a backhoe constructed such that its boom is movable to a transport position wherein it extends over a swing frame of the backhoe.

In order to shift the weight of a backhoe closer to its carrying vehicle so as to effect a more stable backhoe-carrying vehicle combination for transport, it is known to incorporate means in the backhoe structure for permitting the boom to be selectively swung towards the carrying vehicle beyond a normal fully raised working position. Heretofore, these incorporated means have included one or more of the disadvantages of being too complicated or of being arranged such that the center of gravity of the backhoe structure remains too high to obtain the stability desired.

SUMMARY OF THE INVENTION

According to the present invention, there is provided a novel backhoe structure and more specifically there is provided a backhoe structure incorporating novel means through which the boom may be moved to a transport position.

A broad object of the invention is to provide a backhoe structure including means by which the boom may be shifted to a transport position wherein the center of gravity thereof is disposed closer to the carrying vehicle than it is when the boom is in a fullly raised working position.

Another object is to provide a simple means by which a backhoe boom may be readied for movement to its transport position.

A more specific object is to provide a backhoe boom which is selectively foldable from a fully raised position wherein it extends outwardly from a swing frame and a transport position wherein an outer section thereof extends over the swing frame.

These and other objects will become apparent from a reading of the following description taken together with the appended drawing.

BRIEF DESCRIPTION OF THE DRAWING

The sole FIGURE is a side elevational view of a backhoe-carrying vehicle combination wherein the backhoe is constructed according to the principles of the present invention and is shown in a folded transport position and with the outer section of the boom being shown in dashed lines in a fully raised operating position.

DESCRIPTION OF THE PREFERRED EMBODIMENT

Referring to the drawing, therein is shown a tractor 10 serving as a carrying vehicle for a loader 12 attached thereto for operation at the forward end thereof and a backhoe 14 attached thereto for operation at the rearward end thereof.

The tractor 10 includes front and rear pairs of support wheels 16 and 18, respectively. Mounted within a cab 20 mounted between the wheels 18 is a seat 22 positioned just rearwardly of a steering wheel 24. Other controls (not shown) are provided in the cab 20 for controlling the operation of the loader 12 and backhoe 14.

The loader 12 includes a pair of arms 26 located on opposite sides of the tractor 10 and having their rear ends vertically pivotally connected to a support structure 28. A bucket 30 is vertically pivotally connected to the forward ends of the arms 26. A pair of two-way hydraulic arm lift actuators 32 are connected between the structure 28 and the arms 26 and a hydraulic bucket tilt actuator 34 is connected between the bucket 30 and a cross member 36 joining the arms 26.

The backhoe 14 includes a support frame 38 fixed to the back of the tractor 10. A swing frame 40 is horizontally pivotally mounted on the frame 38 by cooperating hinge means of the frames 38 and 40 including a vertical hinge pin 44. Normally some sort of power means would be provided to effect movement of the swing frame 40 however such a means is not shown here for the sake of brevity.

A backhoe bucket 46 is supported from the swing frame 40 for selected vertical pivotal movement by means including a dipper stick 48 and a two-piece boom 50. Specifically, the bucket 46 is vertically pivotally connected to one end of the dipper stick 48 and a two-way hydraulic bucket pivot or curl actuator 52 is connected between the dipper stick 48 and the bucket 46. The dipper stick 48 is vertically pivotally connected, with reference to the swing frame 40, to an outer free end of an outer section 54 of the boom 50 and a two-way hydraulic dipper stick actuator 56 is connected between the dipper stick 48 and the boom section 54. An inner section 58 of the boom 50 includes a pair of transversely spaced members 60 having their outer ends disposed on opposite sides of and pivotally connected to the outer boom section 54 through means of a horizontal pin 62, and having their inner ends disposed between and pivotally connected to lower rear portions of a pair of vertical flanges 64 of the swing frame 40 through means of a horizontal pin 66. A pair of transversely spaced two-way hydraulic boom actuators 68 are located on opposite sides of the dipper stick actuator 56 and are connected between the outer boom section 54 and upper portions of the flanges 64 of the swing frame 40.

The backhoe 14 is illustrated in a transport condition wherein the center of gravity thereof is disposed as far toward the tractor 10 as possible. Specifically, the outer section 54 of the boom 50 is in an extreme counterclockwise position (determined by complete retraction of the actuators 68) about the pivot pin 62 wherein the section 54 out of alignment with the inner section 58 and is inclined upwardly and forwardly over the swing frame 40 toward the tractor 10; and the inner section 58 of the boom 50 is in an extreme counterclockwise or raised position determined by engagement with a pair of stop surfaces 70 respectively defined by rearwardly facing surfaces of the flanges 64.

A transverse lock pin 72 is for convenience, here shown stored in aligned holes (not shown) provided in the inner boom section 58 and when the lock pin 72 is removed and the boom section 54 is moved to an operative position, illustrated in dashed lines, wherein it is aligned with the inner section 58, a transverse hole 74 in the inner end of the boom section 54 is aligned with the holes in the section 58 so that the pin 72 may be reinserted to lock the sections 54 and 58 together to rigidify the boom 50 for vertical swinging movement during normal operation. Here shown, for convenience, in addition to the pin 72 but normally being provided as an alternative structure is a one-way hydraulic lock actuator 76 connected between the outer and inner boom sections 54 and 58. The actuator 76 is here shown in a collapsed non-pressurized state, and is dimensioned such that when it is in a pressurized fully extended position, the outer boom section 54 will be locked in alignment with the inner boom section 58.

The operation of the two-piece boom 50 of the backhoe 14 is thought to be clearly apparent from the foregoing description and for the sake of brevity no extended discussion of the operation is given. Suffice it to say that, with all other things being equal, making the boom 50 of inner and outer pivotally interconnected sections makes it possible to attain a transport condition wherein the center of gravity of the backhoe parts rearwardly of the swing frame 40 is disposed closer to the tractor 10 than would be possible if the boom 50 were made of a rigid structure.

We claim:

1. A backhoe structure comprising: a swing frame; a boom including, with reference to the swing frame, an inner section vertically pivotally connected to the swing frame; an outer section vertically pivotaly connected to the inner section; an extensible and retractable hydraulic actuator connected between the outer section and the swing frame; a releasable lock means normally preventing the outer section from pivoting relative to the inner section to thereby rigidify the boom whereby the hydraulic actuator is operative to move the inner and outer sections between respective fully raised and lowered operating positions; stop means for preventing the inner section from moving upwardy beyond its fully raised position; and said lock means being releasable to permit the outer section to be pivoted by the actuator upwardly beyond its fully raised position to a transport position.

2. The backhoe structure defined in claim 1 wherein the inner section has an outer end portion overlapping an inner end portion of the outer section inwardly of the pivotal connection between the inner and outer sections; and said lock means including a locking pin removably inserted through said outer and inner end portions.

3. The backhoe structure defined in claim 1 wherein said lock means includes a one-way hydraulic actuator connected between the inner and outer sections.

4. The backhoe structure defined in claim 3 wherein the one-way hydraulic actuator extends across the pivotal connection between the inner and outer sections.

5. In a backhoe structure including a swing frame having connection means adapted for mounting the swing frame for movement about an upright axis, a boom having one end vertically pivotally connected to the swing frame at a location on a side opposite from the connection means, and an extensible and retractable hydraulic actuator connected between the swing frame and the boom for selectively raising and lowering the boom about its pivotal connection with the swing frame, the improvement comprising: said boom, with reference to the swing frame, including inner and outer sections connected together by a horizontal pivot pin and a releasable lock means for normally preventing relative pivotal movement of the inner and outer sections about the pivot pin; said hydraulic actuator being connected to the outer section; said swing frame including abutment surface means for engaging the inner section for preventing the latter from being raised beyond a position wherein it projects away from the swing frame; and the outer section being so located relative to the swing frame that when the lock means is released the actuator may move the outer section about the pivot pin to a transport position wherein it projects over the swing frame.

6. The backhoe structure defined in claim 5, wherein the inner section has an outer end portion overlapping an inner end portion of the outer section inwardly of the pivotal connection between the inner and outer sections; and said lock means including a locking pin removably inserted through said outer and inner end portions.

7. The backhoe structure defined in claim 5, wherein said lock means includes a one-way hydraulic actuator connected between the inner and outer sections.

8. The backhoe structure defined in claim 7 wherein the one-way hydraulic actuator extends across the pivotal connection between the inner outer sections.

* * * * *